United States Patent [19]

Wells et al.

[11] Patent Number: 4,655,177

[45] Date of Patent: Apr. 7, 1987

[54] ROCKER ARM SUPPORT ASSEMBLY

[75] Inventors: Larry Wells, Columbus; James D. Baugh, Greensburg, both of Ind.

[73] Assignee: Cummins Engine Company, Inc., Columbus, Ind.

[21] Appl. No.: 749,753

[22] Filed: Jun. 28, 1985

[51] Int. Cl.[4] ..... F01M 11/02

[52] U.S. Cl. ..... 123/90.36; 123/90.33; 184/6.9

[58] Field of Search ..... 123/90.33, 90.36, 90.39; 184/6.9

[56] References Cited

U.S. PATENT DOCUMENTS

| | | | |
|---|---|---|---|
| 1,281,246 | 10/1918 | Sturtevant | 123/90.33 |
| 1,784,767 | 12/1930 | Summers | 123/90.36 |
| 1,855,166 | 4/1932 | Cranford | 123/90.36 |
| 1,871,623 | 8/1932 | Le Fevre | 123/90.33 |
| 2,047,446 | 7/1936 | Taylor | 123/90.4 |
| 2,224,376 | 12/1940 | Chayne et al. | 123/90.36 |
| 2,288,831 | 7/1942 | O'Harrow | 123/90.36 |
| 2,749,888 | 6/1956 | Roos | 123/90.36 |
| 2,976,862 | 3/1961 | Allen | 123/90.33 |
| 3,008,544 | 11/1961 | Krizman | 123/90.36 |
| 3,140,699 | 7/1964 | Rassushin | 123/90.36 |
| 3,251,350 | 5/1966 | Thompson | 123/90.33 |
| 4,086,887 | 5/1978 | Schoonover et al. | 123/90.77 |
| 4,505,236 | 3/1985 | Nakamura | 123/90.35 |

FOREIGN PATENT DOCUMENTS 355400 8/1931 United Kingdom.

*Primary Examiner*—Ira S. Lazarus

*Attorney, Agent, or Firm*—Sixbey, Friedman & Leedom

[57] ABSTRACT

A rocker arm assembly for an internal combustion engine is provided which is lightweight and inexpensive to manufacture, which securely mounts and supports a pair of rocker arms and associated structures on the cylinder head of an internal combustion engine, and which provides and maintains a supply of lubricant to the rocker arm bearing structures, valves and push rods. The rocker arm assembly includes a two part pedestal which clamps the shaft on which the rocker arms are journaled to the engine. The base portion of the pedestal includes a pair of positioning projections which position and support the pedestal so that the proper alignment of the rocker arms relative to the longitudinal axis of the engine is achieved and maintained.

31 Claims, 5 Drawing Figures

ROCKER ARM SUPPORT ASSEMBLY

DESCRIPTION

1. Technical Field

The present invention relates generally to supports for the rocker arms and related structures in an internal combustion engine and particularly to a support assembly for rocker arms which is designed to provide a metered flow of lubricant to the rocker arm bearing surfaces, the valves and the push rods of an internal combustion engine.

2. Background Art

Providing supporting structures for the rocker arms responsible for actuating the valves in an internal combustion engine which also provides and maintains an adequate supply of lubricating fluid from the engine lubrication circuit has long been a concern of the prior art. During engine operation, the rocker arms and associated structures are in intermittent rapid motion which must be sustained until the engine is turned off. If the proper amount of lubricant is not supplied to the rocker arm bearing surfaces, valves and pushrods, engine operation will be adversely affected. Moreover, if the rocker arms are not securely supported and mounted on the engine, the rapid motion required of the rocker arms cannot be sustained.

If too little lubricant is supplied to these structures, the frictional forces created by their intermittent movement will not be overcome, and they will experience excessive wear, overheat, warp and even catastrophically fail. Conversely, if too much lubricant is supplied to the rocker arms and associated structures, the engine will experience parasitic pumping losses, thereby reducing engine efficiency and adversely affecting the commercial acceptance of the engine.

In addition to securely mounting the rocker arms on the engine and conveying adequate lubricant to the bearing surfaces and associated structures, the precise positioning of the rocker arm assembly on the engine is important to both rocker arm life and proper valve operation. If the valve actuating portion of each rocker arm is not properly aligned with the rocker arm engaging portion of each valve stem, the rocker arm will be subject to uneven wear, and the valves are not likely to function as efficiently. The ideal rocker arm support assembly, therefore, will include structure which conveys a controlled supply of lubricant from the engine lubrication circuit to the bearing surfaces of the rocker arms, to the valves and to the push rods. The lubricant conveying structures of the ideal rocker arm support assembly will, in addition to conveying lubricant, comprise a support structure which is sufficiently strong to secure the rocker arm to the engine and sufficiently durable to withstand the constant motion to which the rocker arm is subjected during engine operation. Additionally, the rocker arm support structure should be easy to assemble and to install precisely on the engine and should add the least additional weight to the engine consistent with achieving all of the above objectives. Proper alignment of the rocker arm and valve stem should further be achieved automatically upon installation of the support assembly on the engine.

Many prior art rocker arm mounting assemblies include a cylindrical shaft upon which the rocker arms are journaled, usually in pairs, such as is shown in U.S. Pat. Nos. 1,281,246 to Sturtevant and 2,047,446 to Taylor. Both of these rocker arm supports employ multiple bolts or similar fastening means to secure the rocker arm to adjacent supporting structures, which must then be mounted on the engine, thus adding to the weight of the assembly. U.S. Pat. Nos. 1,871,623 to LeFevre and 3,251,350 to Thompson disclose the use of a single bolt which is inserted through the rocker arm support shaft to engage the engine head. Both of these references however, require additional separate structures to convey lubricant to the rocker arm bearing surfaces, and neither reference discloses structure either for providing a controlled flow of lubricant to the valves and push rods or for assuring precise installation on the engine.

Rocker arm support structure which functions simultaneously to convey lubricant and to support a rocker arm rotatably journaled on a cylindrical support shaft are disclosed in U.S. Pat. Nos. 2,288,831 to O'Harrow and 2,976,862 to Allen. Both patents require only a single central mounting stud to secure the rocker arm assembly to the engine, and this mounting stud must be specially machined to include a lubrication channel to convey lubricant from the engine to the rocker arm. Moreover, the lubrication channel in the stud must align precisely with a lubrication passage in the engine upon installation for sufficient lubricant to be conveyed from the engine to the rocker arm. In U.S. Pat. No. 2,976,862, no auxiliary support structure is provided, and a single mounting stud secures each rocker arm directly to both its support shaft and to the engine. This arrangement, however, despite its apparent advantages, can be used to support only a single rocker arm and associated structures so that a separate, specially machined mounting stud is required for each rocker arm. Such an arrangement reduces neither engine weight nor cost and, in fact, may increase both.

The prior art, therefore, has failed to disclose simple, lightweight, inexpensive support structure which can be employed both to mount an assembly including a pair of rocker arms and associated structures on the head of an internal combustion engine and automatically align and position the assembly in proper alignment and simultaneously to convey lubricant from the engine lubrication circuit to the rocker arm bearing surfaces, the valves and the push rods.

SUMMARY OF THE INVENTION

It is a primary object of the present invention, therefore, to overcome the deficiencies of the prior art discussed above and to provide a simple, lightweight support assembly for a pair of rocker arms which simultaneously securely mounts and precisely aligns the rocker arms and related structures on the engine and conveys lubricant from the engine lubrication circuit to the bearing surfaces of the rocker arms, the valves and the push rods.

It is another object of the present invention to provide a two part pedestal positioned centrally between a pair of rocker arms rotatably journaled on a supporting shaft wherein the pedestal supports the shaft directly and securely mounts the rocker arms on the engine head and precisely aligns the pair of rocker arms relative to the longitudinal axis of the engine.

It is yet another object of the present invention to provide a support assembly for a pair of rocker arms rotatably journaled on a shaft including a pair of spaced parallel channels perpendicular to the axis of the shaft for simultaneously receiving a pair of longitudinal mounting means and for conveying lubricant from a source of lubrication fluid in fluid communication with the engine lubrication circuit.

It is a still further object of the present invention to provide a support pedestal for a pair of rocker arms rotatably journaled on a shaft including a base portion adapted on one side to be flushly mounted on a pedestal receiving surface on an engine cylinder head and adapted on the other side to receive a first lower portion of a rocker arm carrying shaft and a shaft retainer clamp adapted to receive a second, upper portion of a rocker arm carrying shaft. The lateral extent of the shaft retainer clamp is only slightly greater than the diameter of the rocker arm support shaft, thereby reducing the required weight and size of the rocker arm support assembly.

It is yet a further object of the present invention to provide a support pedestal for a rocker arm support assembly having a base portion which includes a pair of downwardly extending positioning projections which engage mating bores in the cylinder head to position the support pedestal so that the rocker arms are precisely aligned with respect to the longitudinal axis of the engine.

It is yet a further object of the present invention to provide a support pedestal for a rocker arm support assembly having a base portion which further includes a lubricant receiving extension containing an interior lubricant supply channel in fluid communication with a pair of lubricant supply channels in the interior of the base portion to convey lubricant from a lubricant supply rail connected to the engine lubrication circuit to the rocker arms, wherein the extension also supports rocker cover mounting means.

It is yet a further object of the present invention to provide a rocker arm support assembly which supports a shaft positioned parallel to the longitudinal axis of the engine, wherein the shaft includes a pair of large centrally located, spaced lubricant supply bores positioned transverse to the longitudinal axis of the shaft, a central longitudinal transfer bore to convey lubricant from the supply bores outwardly along the shaft to a pair of small lubricant transfer bores positioned transverse to the longitudinal axis of the shaft in fluid communication with a pair of rocker arms.

It is yet a still further object of the present invention to provide a rocker arm including a lubricant feed passage which intermittently fluidically communicates with a lubricant transfer bore located in the shaft on which the rocker arm is rotatably journaled to provide a metered supply of lubricant to a lubrication trough on the rocker arm so that an equal amount of lubricant flows to each end of the rocker arm during engine operation.

In accordance with the aforesaid objects a support assembly for a pair of rocker arms rotatably journaled on a shaft wherein the support assembly has a pedestal which includes a base portion with a pair of positioning projections on one side to engage positioning bores on a pedestal mounting surface on the upper surface of the cylinder head and a shaft engaging groove on the other side. The base portion further includes a lubricant receiving extension which sealingly engages a lubricant supply rail. Lubricant transfer channels are provided in the receiving extension and in the base portion to provide a fluid path to convey lubricant from the lubricant supply rail to the shaft. The pedestal additinally includes a retaining clamp adapted to secure the shaft to the base portion. When the pedestal is assembled around the shaft, a pair of central channels perpendicular to the axis of the shaft is formed which function both to receive mounting bolts to maintain the pedestal in an assembled condition around the shaft and mount it securely to the cylinder head and to convey lubricant from the lubricant supply rail to the rocker arms. The controlled delivery of a supply of lubricant sufficient to keep the rocker arm mounting shaft, valves and push rods properly lubricated is achieved by providing a pair of transverse lubricant transfer bores spaced outwardly of the central channels, each of which corresponds with a lubricant feed passage in each rocker arm so that during engine operation the shaft transfer bores are in intermittent fluid communication with the rocker arm feed passages to provide a metered supply of oil to the top of the rocker arm as it oscillates on the shaft. The upper surface of each rocker is further provided with a lubrication trough which receives lubricant from the feed passage wherein the outlet end of the feed passage connects with the lubrication trough so that each end of the rocker arm receives an equal amount of lubrication during engine operation.

Other objects and advantages will become apparent following an examination of the following description and drawings and the appended claims.

BEST MODE FOR CARRYING OUT THE INVENTION

The rocker arm support assembly of the present invention is intended for use on an internal combustion engine of the type which includes a cylinder block with plural cylinders wherein the cylinder ends are closed by a head containing valves to control cylinder operation. Typically, the valves are retained in a closed position by springs and are adapted to be opened by rocker arms actuated by push rods, which are indirectly driven by the engine crankshaft. Since the rocker arms are in intermittent rapid motion during engine operation, they must be properly positioned and aligned relative to the longitudinal axis of the engine and properly lubricated to assure the sustained, trouble-free functioning of the engine.

Figure 1:
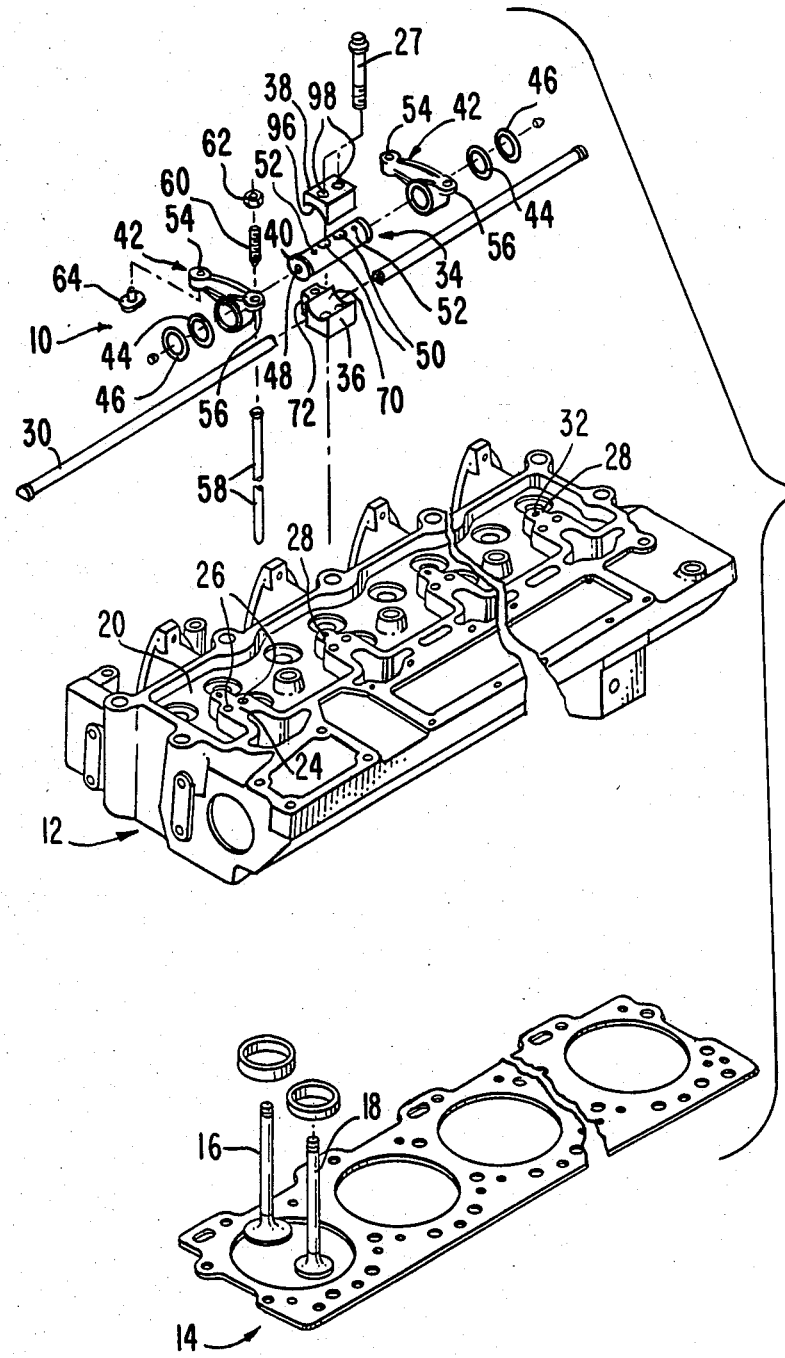
FIG. 1 is an exploded perspective view of the rocker arm support assembly of the present invention in combination with the head of an internal combustion engine.

Referring to the drawings, FIG. 1 shows an exploded perspective view of the head portion of an internal combustion engine with the component parts of the present rocker arm assembly 10 pictured in an exploded view just above the cylinder head 12 and the cylinder head gasket 14. Although only one rocker assembly is shown in FIG. 1, the portion of the head shown will provide mounting sites for four such assemblies. Only one rocker support assembly will be described herein, because the mounting structures for each pair of rockers are essentially identical. During assembly of the engine, the head 12 would be secured to the block, with the gasket 14 interposed between the head and the block. Pairs of valves like intake valve 16 and exhaust valve 18 are associated with each cylinder. When the head is positioned on the cylinder, the valve stems extend through the head to contact one end of the rocker arm as will be discussed in detail hereinbelow.

The upper surface 20 of the head 12 is provided with a rocker assembly pedestal mounting 24 for each pair of rocker arms. The rocker assembly pedestal mounting includes a pair of threaded, spaced bolt receiving holes 26 which are spaced a predetermined distance to permit a pair of bolts, cap screws or similar fasteners to be inserted to securely mount the assembly to the head. A single cap screw 27 is shown in FIG. 1. The bolt receiving holes are counterbored as will be described hereinbelow to receive a pair of positioning projections 86 (FIG. 3) in the bottom of the rocker arm mounting assembly. Each pedestal mounting 24 also includes a nose portion 28 which supports and mounts a lubricant supply rail 30 on the head. The nose portion 28 shown toward the far side of the head in FIG. 1 is the location of the outlet port 32 of the engine lubrication circuit. Outlet port 32 communicates fluidically with a corresponding lubricant inlet port in the supply rail 30 in a manner which is described in the copending application Ser. No. 749,754, of Larry Wells and Karl Graham entitled LUBRICANT SUPPLY RAIL, filed on this same date and assigned to the same assignee as the present application, the disclosure of which is hereby incorporated by reference. Lubricant is thus conveyed from the engine lubricant circuit into the rail 30 and from there to each rocker arm assembly 10.

Each rocker arm assembly 10 includes a two part pedestal 34, which further includes a base 36 and a retainer clamp 38 which support and hold in place on the head a cylindrical shaft member 40. The shaft, which is mounted parallel to the longitudinal axis of the engine, preferably extends only a sufficient distance along the engine axis to receive the retainer clamp 38, a pair of rocker arms 42, and the washers 44 and rings 46 required to prevent the rocker arms from slipping off the ends of the shaft 40. The shaft 40 is provided with a central longitudinal passage 48, which extends the entire length of the shaft, and two sets of bores which are positioned transversely through the shaft perpendicular to the axis of the central passage.

One set of bores 50 is located toward the center of the shaft, and the second set of bores 52 is positioned outwardly from bores 50 toward the ends of the shaft. The set of bores 50 are equal in diameter, but larger than the set of bores 52, which are also of equal diameter. The bores 50 function both to receive the pair of cap screws, of which only a single cap screw 27 is shown in FIG. 1, and to provide a lubrication flow channel in which lubricant is directed along the axis of the cap screws from the pedestal base 36 to shaft central passage 48. Consequently, the diameter of bores 50 is selected to be only slightly larger than cap screw 27 so that the cap screws fit loosely within the bores 50 to leave sufficient room for lubricant to flow in a path parallel to each cap screw. The bores 50 intersect with the shaft central passage 48, providing a fluid path from the shaft to two opposite exterior surfaces of the shaft. One of each of the pairs of smaller bores 52 is located toward each end of the shaft 40 and intersects the central passage 48 to extend completely through the shaft to two opposite surfaces of the shaft, as do bores 50. Bores 52, therefore, provide a fluid path which directs fluid from the lubricant supply to bores 50, outwardly along passage 48 to bores 52, and then through bores 52 to the exterior of shaft 40 and to the rocker arms. The outer surface of shaft 40 is thus kept supplied with lubricant from this fluid circuit.

Each rocker arm 42 has a valve actuating end 54 and a push rod communicating end 56. As the rocker arm oscillates on the shaft 40 during engine operation, the push rod 58, one end of which contacts the rocker arm 42 through an appropriate adjustable fastener, such as screw 60 and nut 62, forces the rocker arm to oscillate in a plane perpendicular to the central axis of shaft 40 which, in turn, causes the rocker arm to actuate a corresponding intake or exhaust valve. An insert pad 64 on this end of the rocker arm contacts the upper end of each corresponding valve stem.

Figure 2:
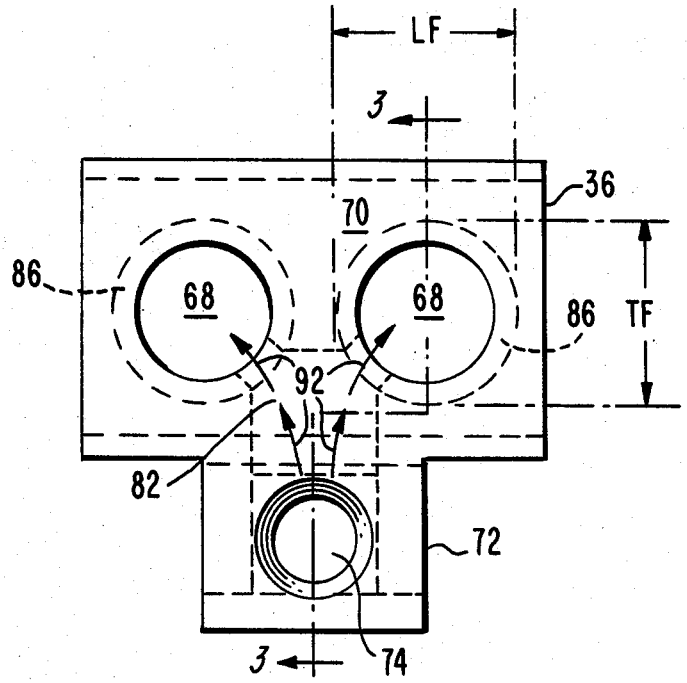
FIG. 2 is a plan view of the head engaging surface of the bottom portion of the pedestal of the rocker arm support assembly illustrated in FIG. 1.
Figure 3:
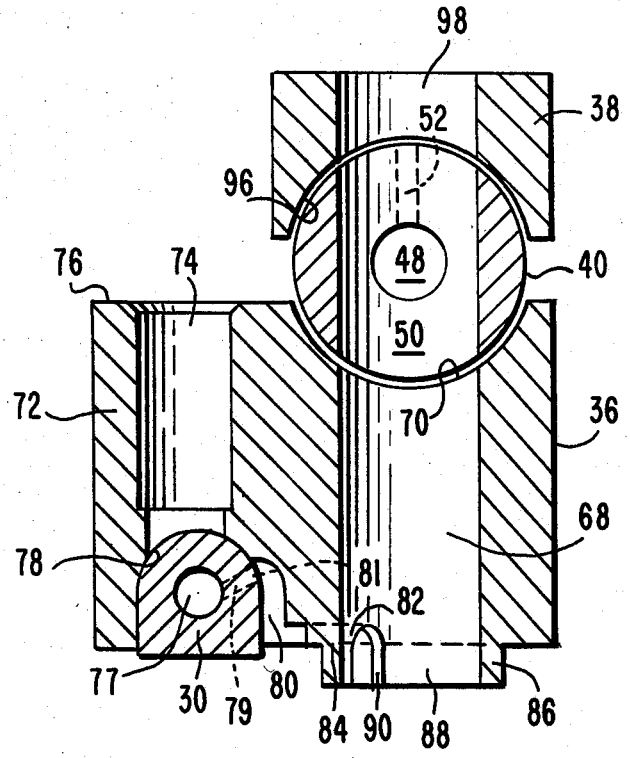
FIG. 3 is a cross-sectional view taken along lines 3—3 of FIG. 2.

The internal lubricant circuit of the present rocker arm support assembly is shown in greater detail in FIGS. 2 and 3. This circuit is substantially completely contained within the rocker arm pedestal structures. FIG. 2 illustrates the base 36 of the pedestal as viewed from above. The shaft 40, which is not shown in FIG. 2, would be positioned along the longitudinal axis of the base 36 and supported above a pair of lubricant and cap screw receiving passages 68 formed in the base which align with bores 50 in the shaft 40 when the shaft is in place. The upper surface 70 of the base portion 36 is contoured to have a concave semi-cylindrical shape as shown in FIGS. 1 and 3 to receive the bottom portion of the cylindrical shaft 40. The base 36 also includes a lubricant receiving extension 72 which both secures the lubricant supply rail against the nose portion 28 of the pedestal support surface 24 on the engine head and provides fluid communication between the lubricant supply rail and the shaft 40 through the pedestal base portion 36. The size and location of the lubricant and cap screw receiving passages 68 in the base is chosen to create an aligned annular lubricant flow passage around the circumference of each cap screw which extends from the holes 26 in the engine head through bores 50 in the shaft 40 when the base is installed on the engine head and the shaft is positioned on the base.

The lubricant receiving extension 72 is provided with a threaded bore 74 which is located on the upper surface 76 of the extension 72. This threaded bore is not part of the pedestal lubrication circuit, but receives a mounting bolt (not shown) which secures a cover structure (not shown) over all of the rocker arm assemblies mounted on the cylinder head.

FIG. 3 illustrates, in a side cross-sectional view taken along lines 3–3 of FIG. 2, further details of the lubricant fluid circuit of the rocker support pedestal base 36. The lubricant receiving extension 72 includes a lubricant rail receiving and sealing surface 78 that is adapted to conform to the cross-sectional configuration of the lubricant supply rail 30. The sealing surface 78 sealingly engages the lubricant supply rail 30 between the nose portion 28 of pedestal mount 24 on the head and interior of the lubricant receiving extension 72. The height of the lubricant rail 30 is slightly greater than the height of the opening formed by sealing surface 78 so that when the rocker arm support assembly is mounted on the engine, the rail 30 will be biased toward the nose portion 28 to create a tight seal. A lubricant transfer bore 79, including a supply port 81, is located in the upper surface of the rail to convey lubricant from the rail lubricant passage 77 to an undercut 80 which communicates with a recess 82 formed in the lower surface 84 of the pedestal base portion 36. Recess 82 then communicates fluidically with lubricant and cap screw receiving passage 68 so that lubricant can be conveyed upwardly toward the shaft 40.

FIGS. 2 and 3 illustrate clearly, in addition, structure which enable the present rocker arm support assembly to achieve simultaneously the dual functions of conveying lubricant from the cylinder head to the rocker arms and precisely positioning the support assembly on the engine to insure the accurate alignment of the rocker arms relative to the shaft and the valve stems. The base 36 is provided with a pair of positioning projections or dowels 86 arranged to extend downwardly to engage counterbores (not shown) in the pedestal mount 24 which are positioned concentrically in relation to the bolt receiving holes 26. The central opening 88 of the positioning projection 86 shown in FIG. 3 aligns generally with the passage 68. The primary function of the positioning projections 86 is to mount the rocker arm assembly on the engine so that the rocker arm rotational axis is properly aligned. Pursuant to this objective, projections 86 are formed to provide a tight fit in the direction indicated by arrows TF in FIG. 2 and a loose fit in the perpendicular direction indicated by arrows LF in FIG. 2. Providing a tight fit in only one direction not only reduces the costs associated with the need to machine parts precisely within minimal tolerances, but also, in this instance, guarantees the parallel alignment of the central axis of the rocker arm support shaft relative to the longitudinal axis of the engine as is required for minimizing wear between the ends of the rocker arms and the corresponding valve stems. The projections 86 also include slotted openings 90 formed therein which provide the necessary fluid connection between recess 82 and passage 68.

Lubricant is thus conveyed from the rail 30 into the rocker arm pedestal base 36 through undercut 80 to the recess 82 and then through slotted openings 90 into passage 68, generally along the path shown by arrows 92 in FIG. 2. Each passage 68 communicates at pedestal base upper surface 70 with a corresponding bore 50 in the rocker shaft 40 so that lubricant is transferred from passage 68 through bore 50 into the central longitudinal shaft passage 48. The lubricant within the shaft passage 48 is further conveyed to each rocker arm 42 laterally through shaft transfer bores 52. The need of prior art rocker arm supports to provide the kind of mounting stud having a costly, carefully machined interior lubricant flow passage has, therefore, been eliminated.

It is preferred to form the components of the present rocker arm support pedestal of hot pressed powdered metal, although other suitable materials are contemplated to be within the scope of the present invention. The use of hot pressed powdered metal permits the formation of the undercut 80, the recess 82 and the slotted openings 90 by a simple, inexpensive molding/-pressing operation and, therefore, eliminates the need for this portion of the pedestal support assembly to be carefully and precisely machined.

Figure 4:
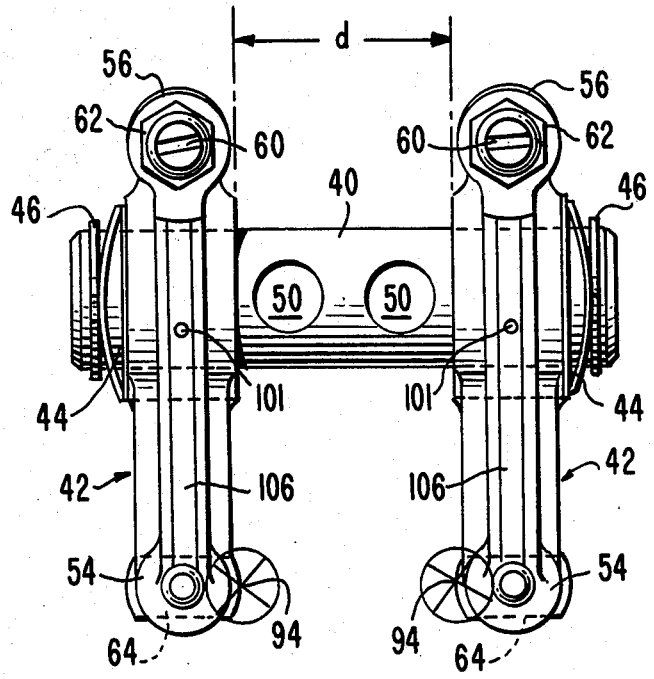
FIG. 4 is a top view of a pair of rocker arms rotatably journaled on a shaft according to the present invention.

The lateral spacing of the rocker arms is dictated by the width of the rocker arm support assembly and particularly by the length of the shaft 40. This distance d, shown in FIG. 4, is ultimately chosen to conform to the locations of the push rods which engage end 56 of each rocker arm. Because the right and left rocker arms are identical in configuration, the resulting positioning of the rocker arms along the shaft 40 separated by a distance d from each other causes the valve stems to engage ends 54 of the rocker arms at an offset location indicated by the x 94 on each rocker arm as illustrated in FIG. 4. If the center of the insert pad 64 on end 54 of the rocker arm contacts the center of the valve stem, the motion of the valve stem is solely in an up and down direction. However, if the insert pad 64 contacts the valve stem at the offset location 94 shown in FIG. 4, the load is moved outward and causes the valve stem to rotate. Valve rotation is thus automatically assured by this arrangement and additional structure to achieve proper valve rotation is, therefore, not required.

The overall weight of the present rocker arm support assembly is further minimized by the use of a pedestal retainer clamp 38 (FIGS. 1 and 3) to secure the shaft 40 to the pedestal base portion 36. The clamp 38 is not required to enclose shaft 40 completely, but extends downwardly over a small portion of the circumference of shaft 40. The clamp includes a concave shaft engaging surface 96 and a pair of centrally positioned bores 98 which are aligned longitudinally with bores 50 in the shaft, passages 68 in the pedestal base 36, central openings 88 in projections 86 and bolt receiving holes 26 in the pedestal mount 24 in the cylinder head. The insertion of a pair of cap screws like cap screw 27 through the longitudinal channels creaated when all these bores and passages are aligned and the tightening of the cap screws in their threaded receptacles securely mounts the entire rocker arm assembly on the engine. Further, as discussed hereinabove, an annular lubricant flow channel parallel to the longitudinal axis of each cap screw is created about the circumference of each cap screw. The dimension of the retainer clamp 38 in the direction perpendicular to the axis of the shaft 40 is only slightly greater than the diameter of the shaft, which significantly minimizes the weight of the entire rocker arm support assembly 10 as compared with prior art support assemblies.

Figure 5:
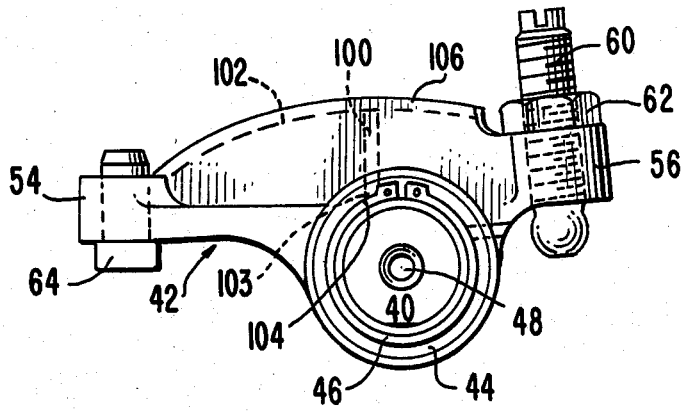
FIG. 5 is a side view of a rocker arm according to the present invention.

The rocker arm 42 is designed to function cooperatively with the rocker arm support assembly 10 in supplying an adequate, controlled flow of lubricant to the bearing surfaces, the valves and the push rods. FIGS. 4 and 5 illustrate features of the design which enable the rocker arms to achieve this objective. Each rocker arm 42 includes a lubricant supply passage 100 bored to extend from the outer surface 102 of the rocker arm to the interior, shaft contacting surface 104 of the rocker arm as can be seen clearly in FIG. 5. Lubricant is supplied to supply passage 100 from outward shaft bores 52 when fluid communication is established between the conduits. Supply passage 100 on each rocker arm communicates with a lubricant distribution groove or trough 106 formed on the upper arcuate surface of each rocker arm which extends along the entire length of the rocker arm between ends 54 and 56. The position of the outlet port 101 of supply passage 100 in each groove 106 is carefully chosen to insure that an equal amount of oil flows to each end to the rocker arm during engine operation. The exact location was chosen following a consideration of the average time that the rocker arm spends in both the valve open and in the valve closed positions. The inlet 103 to supply passage 100 in interior rocker arm surface 104 will be aligned in fluid communication only intermittently with shaft bores 52 during engine operation. When passage 100 and bore 52 are aligned as the rocker arm 42 oscillates on the shaft, lubricant will be transferred from the interior shaft passage 48 to the shaft bore 52 and then through the rocker arm passage 100 to the lubricant distribution groove 106. When these conduits do not align, both bore 52 and passage 100 are blocked, bore 52 by the rocker arm and passage 100 by the shaft, and lubricant cannot travel from the shaft to the rocker arm lubricant distribution groove. The supply of lubricant from the rocker arm support pedestal to the valves through the rocker arms is thereby metered by the movement of the rocker arms and the intermittent alignment of the lubricant supply conduits. The precise positioning of the rocker arm lubricant supply passage within the rocker arm lubricant distribution groove which insures that an equal amount of lubricant is directed to each end of the rocker arm will depend on the exact shape of the rocker arm and will be different for intake and exhaust valve rocker arms of different shapes.

The rocker arm support assembly has been described herein primarily as a support for a pair of rocker arms. However, this is not intended to be limiting, and the present support assembly could be used to support a single rocker arm or more than two rocker arms, as required by the arrangement of the engine.

INDUSTRIAL APPLICABILITY

The rocker arm support assembly of the present invention will find its primary application in an internal combustion engine which employs rocker arms rotatably journaled on a shaft to actuate intake and exhaust valves In this type of engine where it is critical to insure that the proper amount of lubricant is supplied to the rocker arm bearing shaft, valves and push rods during engine operation, the present rocker arm support assembly will insure the supply of the optimum amount of lubricant to these structures. The rocker arm support assembly of the present invention is simpler and less expensive to manufacture than previously known rocker arm support assemblies. Moreover, it can be quickly and easily assembled and installed on an internal combustion engine equipped with a lubrication supply rail located exteriorly of the cylinder head simultaneously to mount and support on the cylinder head a pair of rocker arms in proper alignment with respect to the valves and push rods and to convey a controlled amount of lubricant to the engine structures activated by the rocker arms. The present rocker arm assembly may additionally be employed to achieve reductions in both engine weight and in the cost of manufacturing the components of the assembly.

We claim:

1. A support assembly for mounting at least one rocker arm rotatably journaled on a cylindrical shaft on an internal combustion engine for operating a valve connected with an engine cylinder in response to actuation by a push rod and an engine cylinder head having a locating means for accurately positioning the support assembly relative to the engine valves, said support assembly comprising:

(a) pedestal means for engaging the shaft and securing the shaft to the engine head; and (b) pedestal positioning means located on said pedestal means to extend downwardly therefrom for positively engaging the corresponding location means of the head for positioning said pedestal means so that said shaft is in substantial alignment with the longitudinal axis of the cylinder head.

2. A support assembly as described in claim 1, wherein said pedestal means includes base means for supporting the shaft on the cylinder head having an upper and a lower surface, the upper surface of said base means being shaped to receive and encircle a portion of the circumference of said shaft, said base means including at least one bore extending between the upper and lower surfaces of said base means and further including clamp means for securing said shaft to said base means, wherein said clamp means has an upper and a lower surface, the lower surface of said clamp means being shaped to receive and encircle a portion of the circumference of said shaft opposite that portion of the shaft encircled by said base means, said clamp means including at least one bore extending between said upper and lower surfaces of said clamp means so that when said shaft is received by both said base means and said clamp means, said bore in said base means is aligned with said bore in said clamp means.

3. The support assembly described in claim 2, wherein said shaft includes at least one bore positioned to achieve substantial alignment with the bore in said base means and the bore in said clamp means, thereby forming a parallel channel extending along the longest dimension of said pedestal means.

4. The support assembly described in claim 3, wherein said pedestal positioning means are located to extend from the lower surface of said base means.

5. The support assembly described in claim 4, wherein said pedestal positioning means includes at least one projections extending away from the lower surface of said base means, said projection including a central opening substantially in alignment with the bore in said base means.

6. The support assembly described in claim 5, wherein said locating means includes annular ridge means for receiving said projection, said annular ridge means being shaped to receive said projection loosely along the longest dimension of said projection parallel to the longitudinal axis of the cylinder head and to receive said projection tightly along the longest dimension of said projection perpendicular to the longitudinal axis of the cylinder head.

7. The support assembly described in claim 6, wherein said pedestal engagement means further includes a threaded receptacle positioned within said annular ridge means.

8. The support assembly described in claim 7, further including threaded fastening mens for engaging the longitudinally aligned bores of the clamp means, the shaft, the base means and the threaded receptacle to mount said clamp means, shaft and base means in longitudinal alignment perpendicular to the longitudinal axis of the cylinder head.

9. The support assembly described in claim 3, wherein said shaft further includes at least one transverse transfer bore positioned outwardly of the bore aligned with the corresponding clamp means bore and base means bore and extending through the shaft from the clamp means to the base means, said transfer bore being in fluid communication with the engine lubrication circuit.

10. The support assembly described in claim 9, wherein a pair of rocker arms is rotatably jurnaled on said shaft and maintained in a spaced apart condition directly over said transfer bores by said clamp means.

11. The support assembly described in claim 10, wherein the distance between said rocker arms corresponds to the distance between the push rod contacted by each of said rocker arms.

12. The support assembly described in claim 11, wherein said rocker arms include lubricant metering means for providing a controlled supply of lubricant to opposite ends of each of said rocker arms.

13. The support assembly described in claim 12, wherein said lubricant metering means includes a lubricant feed passage extending from said shaft to the outside surface of each rocker arm and a lubricant supply groove, said passge being positioned in said groove in a location that will provide a substantially equal amount of lubricant to each end of the rocker arm.

14. A support assembly for mounting at least one rocker arm rotatably journaled on a cylindrical shaft on an internal combustion engine having a cylinder head for operating a valve connected with an engine cylinder in response to actuation by a push rod and a lubricant supply rail having a head engaging surface positioned to contact the engine cylinder head in fluid communication with the engine lubrication circuit when said support assembly is secured to the head, a support assembly engaging surface positioned to contact said support assembly, and at least one supply port in said support assembly engaging surface for supplying lubricant to the support assembly, said support assembly comprising pedestal means for engaging the shaft and supporting the shaft in a fixed position relative to the engine head, said pedestal means having an internal lubricant supply circuit for supplying lubricant to the rocker arm and a rail engaging surface for sealingly engaging the rail support assembly engaging surface around the rail support port to form a fluidic connection between the interior of the rail and said internal lubricant supply circuit when said pedestal means is biased against the engine head.

15. The support assembly described in claim 14, wherein said pedestal means includes lubricant fluid supply means integrally formed therewith for transferring lubricant from said lubricant supply rail to the rocker arm.

16. A support assembly for mounting a pair of rocker arms rotatably journaled on a cylindrical shaft on an internal combustion engine equipped with intake and exhaust valves and push rods which are engaged by the rocker arms during engine operation and a lubricant supply rail which is positioned exteriorly of the engine cylinder head to contact the surface of the head in fluid communication with the engine lubrication circuit, said support assembly comprising:

(a) pedestal means for engaging the shaft and securing the shaft to the engine head;

(b) pedestal positioning means extending from said pedestal means for engaging said pedestal means on said cylinder head so that said shaft is in substantial alignment with the longitudinal axis of the cylinder head;

(c) pedestal engagement means located in the cylinder head for receiving said pedestal positioning means extending from pedestal means to secure said shaft in said substantial alignment; and (d) lubricant flow channel means for conveying lubricant from the lubricant supply rail to the interior of said pedestal means and to the exterior of said shaft.

17. A support assembly as described in claim 16, wherein said pedestal means includes base means for supporting the shaft on the cylinder head and having an upper and a lower surface, the upper surface of said base means being shaped to receive and encircle a portion of the circumference of said shaft, said base means including a pair of bores extending between the upper and lower surfaces of said base means and further includes clamp means for securing said shaft to said base means, wherein said clamp means has an upper and a lower surface, the lower surface of said clamp means being shaped to receive and encircle a portion of the circumference of said shaft opposite that portion of the shaft encircled by said base means, said clamp means including a pair of bores extending between said upper and lower surfaces of said clamp means so that when said shaft is received by both said base means and said clamp means, said bore in said base means align with said bores in said clamp means.

18. The support assembly described in claim 17, wherein said shaft includes a pair of bores positioned to achieve substantial alignment with the bore in said base means and the bores in said clamp means, thereby forming a parallel channel extending along the longest dimension of said pedestal means.

19. The support assembly described in claim 18, wherein said pedestal positioning means are located to extend from the lower surface of said base means.

20. The support assembly described in claim 19, wherein said pedestal positioning means includes a pair of projections extending away from the lower surface of said base means, each of said projections including a central opening substantially in alignment with the bores in said base means.

21. The support assembly described in claim 20, wherein said pedestal engagement means includes annular ridge means for receiving said projections, said annular ridge means being shaped to receive said projections loosely along the longest dimension of said projections parallel to the longitudinal axis of the cylinder head and to receive said projections tightly along the longest dimension of said projections perpendicular to the longitudinal axis of the cylinder head.

22. The support assembly described in claim 17, wherein said base means includes lubricant fluid supply engaging means integrally formed therewith for transferring lubricant from the cylinder head to said base means.

23. The support assembly described in claim 22, wherein said lubricant fluid supply engaging means is adapted to sealingly engage said lubricant supply rail and to convey lubricant into said base means therefrom.

24. The support assembly described in claim 23, wherein said lubricant flow channel means provides a direct fluid connection from said lubricant fluid supply engaging means to the interior of said shaft.

25. The support assembly described in claim 24, further including fastening means for engaging the longitudinally aligned bores of the clamp means, the shaft and the base means and the pedestal engagement means to mount said clamp means, shaft and base means in longitudinal alignment on the cylinder head.

26. The support assembly described in claim 18, wherein said shaft further includes a pair of transverse transfer bores positioned outwardly of the bores aligned with the corresponding clamp means bores and base means bores and extending through the shaft from the clamp means to the base means, said transfer bores being in fluid communication with said lubricant flow channel means.

27. The support assembly described in claim 26, wherein each of said rocker arms is rotatably journaled on said shaft and maintained in a spaced apart condition directly over said transfer bores by said clamp means.

28. The support assembly described in claim 27, wherein the distance between said rocker arms corresponds to the distance between the push rods enagaged by said rocker arms.

29. The support assembly described in claim 28, wherein said rocker arms includes lubricant metering means for providing an intermittent controlled supply of lubricant to the valves and push rods.

30. A support assembly for mounting at least one rocker arm rotatably journaled on a cylindrical shaft on an internal combustion engine for operating a valve connected with an engine cylinder in response to actuation by a push rod and an engine cylinder head, said support assembly comprising pedestal means for engaging the shaft to the engine cylinder head, said pedestal means including base means for contacting and engaging a first portion of the circumference of said shaft along the longitudinal axis thereof and separable, removable clamp means for contacting and engaging a second opposite circumferential portion along the axis of said shaft, leaving a third portion and an opposed fourth portion of said shaft uncontacted by said pedestal means and securing said shaft to said base means, wherein the dimension of said clamp means in the direction perpendicular to the longitudinal axis of said shaft is slightly greater than the diameter of said shaft.

31. A rocker arm adapted to be rotatably journaled to oscillate on a support shaft, said shaft including a central lubrication flow passage, a pair of central dual function alignement and lubricant channel bores perpendicular to said central flow passge and a pair of smaller lubricant transfer bores positioned outwardly of said central bores and extending transversely through said shaft along the diameter thereof, said rocker arm including lubricant metering and delivery means for conveying lubricant from the shaft through said transfer bores and delivering at intervals during engine operation an equal quantity of lubricant with each oscillation of the rocker arm.

* * * * *